US007645032B2

(12) United States Patent
Watanabe

(10) Patent No.: US 7,645,032 B2
(45) Date of Patent: Jan. 12, 2010

(54) DROPLET EJECTION HEAD AND METHOD OF MANUFACTURING THE SAME

(75) Inventor: Hidetoshi Watanabe, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 271 days.

(21) Appl. No.: 11/862,882

(22) Filed: Sep. 27, 2007

(65) Prior Publication Data

US 2008/0079777 A1 Apr. 3, 2008

(30) Foreign Application Priority Data

Sep. 29, 2006 (JP) ..... 2006-268133

(51) Int. Cl.
*B41J 2/045* (2006.01)

(52) U.S. Cl. ..... 347/71

(58) Field of Classification Search ..... 347/71, 347/68–70, 72; 400/124.16, 124.17; 29/25.35
See application file for complete search history.

(56) References Cited

U.S. PATENT DOCUMENTS

| | | | | |
|---|---|---|---|---|
| 7,497,559 | B2 * | 3/2009 | Shin et al. | 347/71 |
| 2005/0157104 | A1 | 7/2005 | Hirota et al. | |
| 2006/0061633 | A1 * | 3/2006 | Nakayama | 347/71 |
| 2006/0066690 | A1 * | 3/2006 | Katayama | 347/71 |

FOREIGN PATENT DOCUMENTS

JP 2005-169839 A 6/2005

* cited by examiner

*Primary Examiner*—K. Feggins
(74) *Attorney, Agent, or Firm*—Baker Botts L.L.P.

(57) ABSTRACT

A droplet ejection head according to the present invention includes a layered body made up of a plurality of metal plates in which at least a part of a liquid passage is formed, and an ejection face in which an ejection port provided at one end of the liquid passage and ejecting an ink droplet is formed. The plurality of metal plates in the layered body include m metal plates whose lengthwise directions form the same angle with a rolling direction thereof, and n metal plates whose lengthwise directions form the same angle with the rolling direction. The angle formed between the lengthwise direction of the m metal plates and the rolling direction is different from the angle formed between the lengthwise direction of the n metal plates and the rolling direction.

12 Claims, 10 Drawing Sheets

DROPLET EJECTION HEAD AND METHOD OF MANUFACTURING THE SAME

CROSS REFERENCE TO RELATED APPLICATION

The present application claims priority from Japanese Patent Application No. 2006-268133, which was filed on Sep. 29, 2006, the disclosure of which is herein incorporated by reference in its entirety.

BACKGROUND OF THE INVENTION

1. Field of the Invention

The present invention relates to a droplet ejection head which ejects droplets of ink or the like, and also to a method of manufacturing the droplet ejection head.

2. Description of Related Art

Japanese Unexamined Patent Publication No. 2005-169839 discloses an ink-jet head which ejects an ink droplet to a recording medium. The ink-jet head has a passage unit in which an internal ink passage is formed. The internal ink passage includes a common ink chamber and a plurality of individual ink passages each extending from an exit of the common ink chamber through a pressure chamber to a nozzle. The passage unit has a layered body made up of a plurality of thin metal plates. Through holes formed in the respective metal plates by an etching processing communicate with each other, thereby constituting an ink passage within the passage unit.

SUMMARY OF THE INVENTION

An original material of a thin metal plate is a roll of material which has been prepared by being rolled and then wound in a rolling direction. By stamping a flat plate portion unwound from the roll, a metal plate corresponding to each stamped region is obtained. The metal plate thus obtained is easy to bend along a winding direction of the roll, that is, in a rolling direction. Particularly when a through hole, which constitutes a part of an ink passage, is formed in the metal plate, the metal plate may largely bend because internal stress is partially released. Here, a roll of material has a width predetermined by a standard. Therefore, in order to reduce loss of the roll, a stamping is generally performed in such a manner that a metal plate stamped out from the roll has its width extending along a width of the roll. In such a case, however, a lengthwise direction of the metal plate is the rolling direction of the roll. As a result, the metal plate largely bends along its lengthwise direction. If all metal plates included in a layered body bend along their lengthwise direction, a passage unit as a whole largely bends along its lengthwise direction. This deteriorates a dimension accuracy of an ink-jet head.

An object of the present invention is to provide a droplet ejection head which includes a layered body made up of a plurality of metal plates and hardly bends, and also to provide a method of manufacturing the droplet ejection head.

According to a first aspect of the present invention, there is provided a droplet ejection head comprising a layered body made up of a plurality of metal plates in which at least a part of a liquid passage is formed, and an ejection face in which an ejection port provided at one end of the liquid passage and ejecting an ink droplet is formed. The plurality of metal plates in the layered body include m metal plates (m represents an arbitrary natural number equal to or greater than 1) whose lengthwise directions form the same angle with a rolling direction thereof, and n metal plates (n represents an arbitrary natural number equal to or greater than 1) whose lengthwise directions form the same angle with the rolling direction. The angle formed between the lengthwise direction of the m metal plates and the rolling direction is different from the angle formed between the lengthwise direction of the n metal plates and the rolling direction.

According to a second aspect of the present invention, there is provided a method of manufacturing a droplet ejection head comprising a layered body made up of a plurality of metal plates in which at least a part of a liquid passage is formed, and an ejection face in which an ejection port provided at one end of the liquid passage and ejecting an ink droplet is formed. The method comprises a first metal plate forming step, a second metal plate forming step, a through hole forming step, and a layered body forming step. In the first metal plate forming step, m metal plates (m represents an arbitrary natural number equal to or greater than 1) whose lengthwise directions form the same angle with a rolling direction thereof are formed from an unwound portion of a roll of long material which is wound along the rolling direction. In the second metal plate forming step, n metal plates (n represents an arbitrary natural number equal to or greater than 1) whose lengthwise directions form the same angle with a rolling direction thereof are formed from an unwound portion of a roll of long material which is wound along the rolling direction. The angle formed between the lengthwise direction of the m metal plates and the rolling direction is different from the angle formed between the lengthwise direction of the n metal plates and the rolling direction. In the through hole forming step, a through hole which constitutes a part of the liquid passage is formed in each of the plurality of metal plates including the m metal plates and the n metal plates. In the layered body forming step, the layered body made up of the plurality of metal plates are formed in such a manner that a plurality of through holes communicate with each other.

According to the present invention, the angle formed between the lengthwise direction of the m metal plates and the rolling direction is different from the angle formed between the lengthwise direction of the n metal plates and the rolling direction. Accordingly, in the layered body made up of the plurality of metal plates including the m metal plates and the n metal plates, either one of the m metal plates and the n metal plates restrains the other from bending along its rolling direction. As a result, the layered body does not easily bend, and a dimension accuracy of the liquid ejection head is improved. In addition, rigidity of the liquid ejection head is improved.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
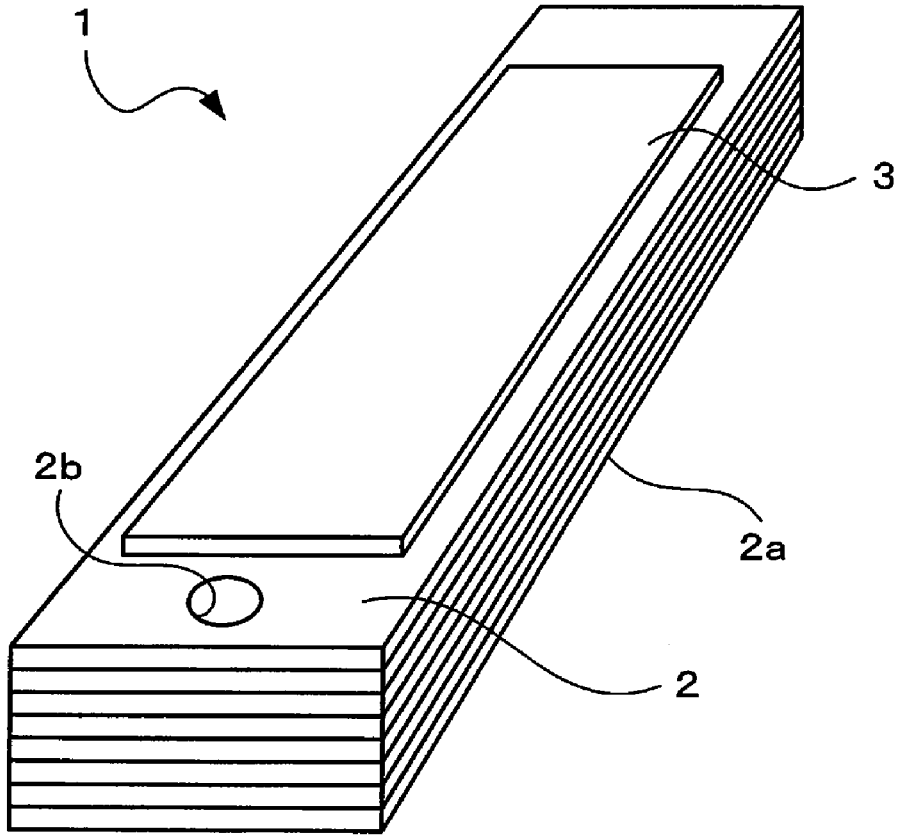
FIG. 1 schematically shows a perspective view of an ink-jet head according to a first embodiment of the present invention.

FIG. 1 shows an ink-jet head which is a first embodiment of a droplet ejection head according to the present invention. The ink-jet head 1 is adoptable in any image recording apparatus of ink-jet type. In a plan view, the ink-jet head 1 has a shape elongated in one direction.

The ink-jet head 1 is fixed to an image recording apparatus so as to be opposed to a paper which is a recording medium conveyed by a conveyor mechanism. The ink-jet head 1 is a line head having a long rectangular parallelepiped shape. A lengthwise direction of the ink-jet head 1 is a main scanning direction. The conveyor mechanism includes a conveyor belt which conveys a paper. The conveyor mechanism conveys a paper, which has been sent out from a paper feed unit, to a region opposed to an ejection face of the ink-jet head 1. The ink-jet head 1 has a print region which extends substantially over a whole width of the conveyor belt. The image recording apparatus is mounted with four ink-jet heads 1 along a paper conveyance direction. The respective ink-jet heads 1 eject ink droplet of different colors, namely, yellow, cyan, magenta, and black, thereby realizing a color printing. Based on image data supplied from the outside, the conveyor mechanism sends a paper to a region opposed to ejection faces of the ink-jet heads 1, and the respective ink-jet heads 1 eject ink droplets to the paper. The paper thus formed with an image thereon is further conveyed and received in a paper discharge tray disposed below.

Figure 2:
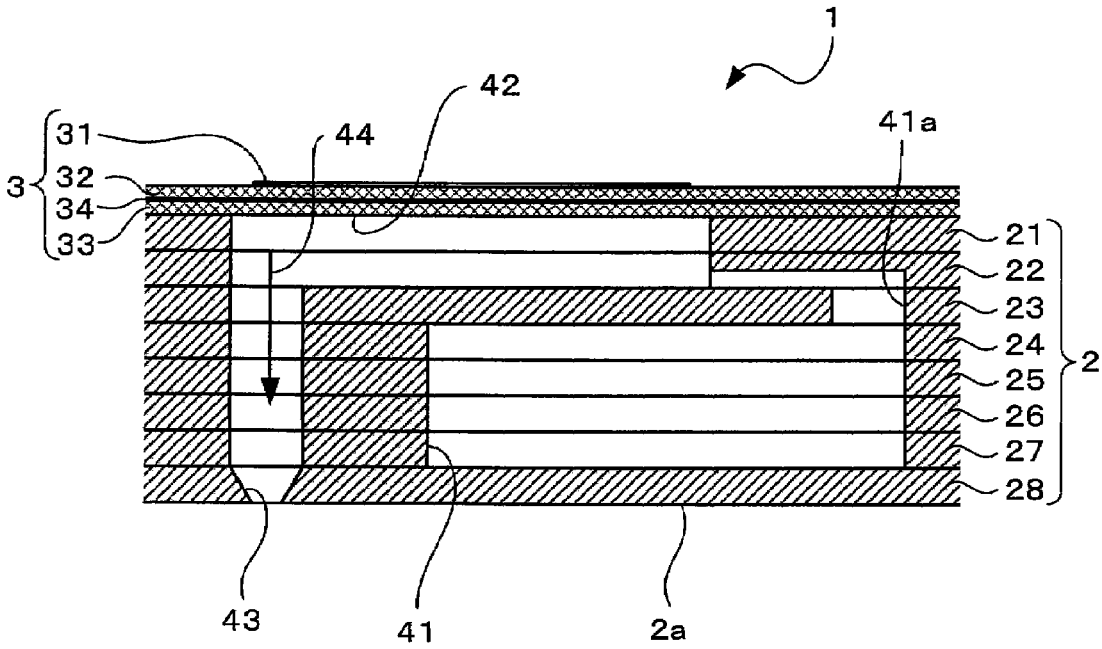
FIG. 2 is a partial sectional view of the ink-jet head shown in FIG. 1.

As shown in FIGS. 1 and 2, the ink-jet head 1 has a passage unit 2 elongated in one direction, and an actuator unit 3 mounted on an upper face of the passage unit 2. The passage unit 2 is a layered body of eight metal plates 21 to 28 made of stainless steel and having substantially the same thickness. An ink supply port 2*b*, into which ink is supplied from the outside, is formed on the upper face of the passage unit 2 and in the vicinity of a lengthwise end of the passage unit 2. A lower face of the passage unit 2 is an ink ejection face 2*a* in which a plurality of ejection ports 43 which eject ink droplets are opened. A plurality of individual ink passages 44 are formed within the passage unit 2. Each of the individual ink passages 44 extends from a common ink chamber 41, into which ink supplied through the ink supply ports 2*b* flows, and an exit 41*a* of the common ink chamber 41 through a pressure chamber 42 to an ejection port 43. FIG. 2 shows a cross section in which only one individual ink passage 44 appears.

Through holes formed by an etching processing in the respective metal plates 21 to 28 are communicated with each other, and thereby the common ink chamber 41 and the plurality of individual ink passages 44 are formed. Respective pressure chambers 42 are opened in the upper face of the passage unit 2. Openings of the respective pressure chambers 42 are closed by the actuator unit 3 which is mounted on the upper face of the passage unit 2. Ink supplied through the ink supply port 2*b* flows through the common ink chamber 41 into the respective individual ink passages 44. The ink having flown into the individual ink passages 44 goes through the pressure chambers 42 and reaches the ejection ports 43 from which the ink is then ejected as ink droplets.

Next, the metal plates 21 to 28 will be described with reference to FIGS. 3 to 5. The metal plates 21 to 28, which constitute the passage unit 2, are prepared by forming through holes by etching in metal plates which have been obtained by stamping a roll of material 50 which is an original material made of stainless steel. The roll of material 50 is a long thin plate made of stainless steel being rolled and wound along a rolling direction. Accordingly, a rolling direction of a portion of the roll of material 50 unwound therefrom is the same as a winding direction of the roll of material 50, that is, an extending direction of the unwound portion of the roll of material 50. Therefore, the unwound portion of the roll of material 50 has internal stress forcing the portion to bend along the rolling direction so as to form an inner surface 50*a* into a concave shape.

Figure 3:
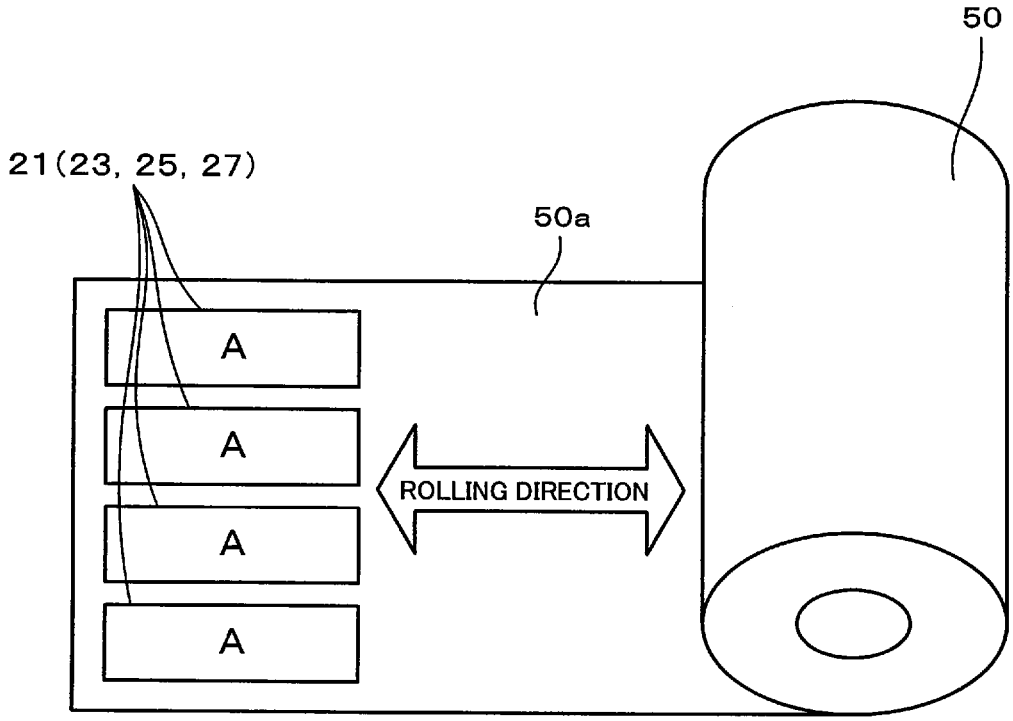
FIG. 3 is an explanatory view showing a relationship between a rolling direction and a lengthwise direction of a part of metal plates included in the ink-jet head.
Figure 4:
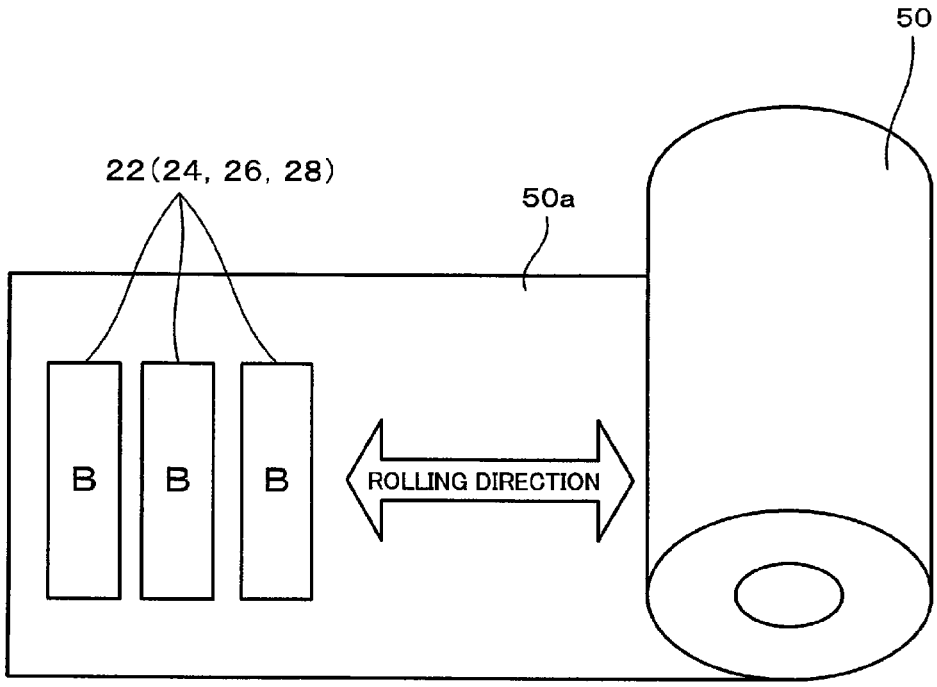
FIG. 4 is an explanatory view showing a relationship between the rolling direction and a lengthwise direction of a rest of the metal plates included in the ink-jet head.

In this embodiment, as shown in FIG. 3, the metal plates 21, 23, 25, and 27 are stamped out of the roll of material 50 in such a manner that a lengthwise direction of the metal plates 21, 23, 25, and 27 is the same as the rolling direction of the roll of material 50. In this case, a maximum number of metal plates per unit area of the roll of material 50 can be obtained from the roll of material 50. Therefore, an amount of the roll of material 50 wastefully discarded can be reduced as much as possible. On the other hand, as shown in FIG. 4, the metal plates 22, 24, 26, and 28 are stamped out of the roll of material 50 in such a manner that a lengthwise direction of the metal plates 22, 24, 26, and 28 is perpendicular to the rolling direction of the roll of material 50. In a following description, the metal plates 21, 23, 25, and 27 whose lengthwise direction is identical to the rolling direction of the roll of material 50 will sometimes be referred to as "first rolled plates" (which are denoted by reference character A in FIGS. 3 and 5), and the metal plates 22, 24, 26, and 28 whose lengthwise direction is perpendicular to the rolling direction of the roll of material 50 will sometimes be referred to as "second rolled plates" (which are denoted by reference character B in FIGS. 4 and 5).

Figure 5:
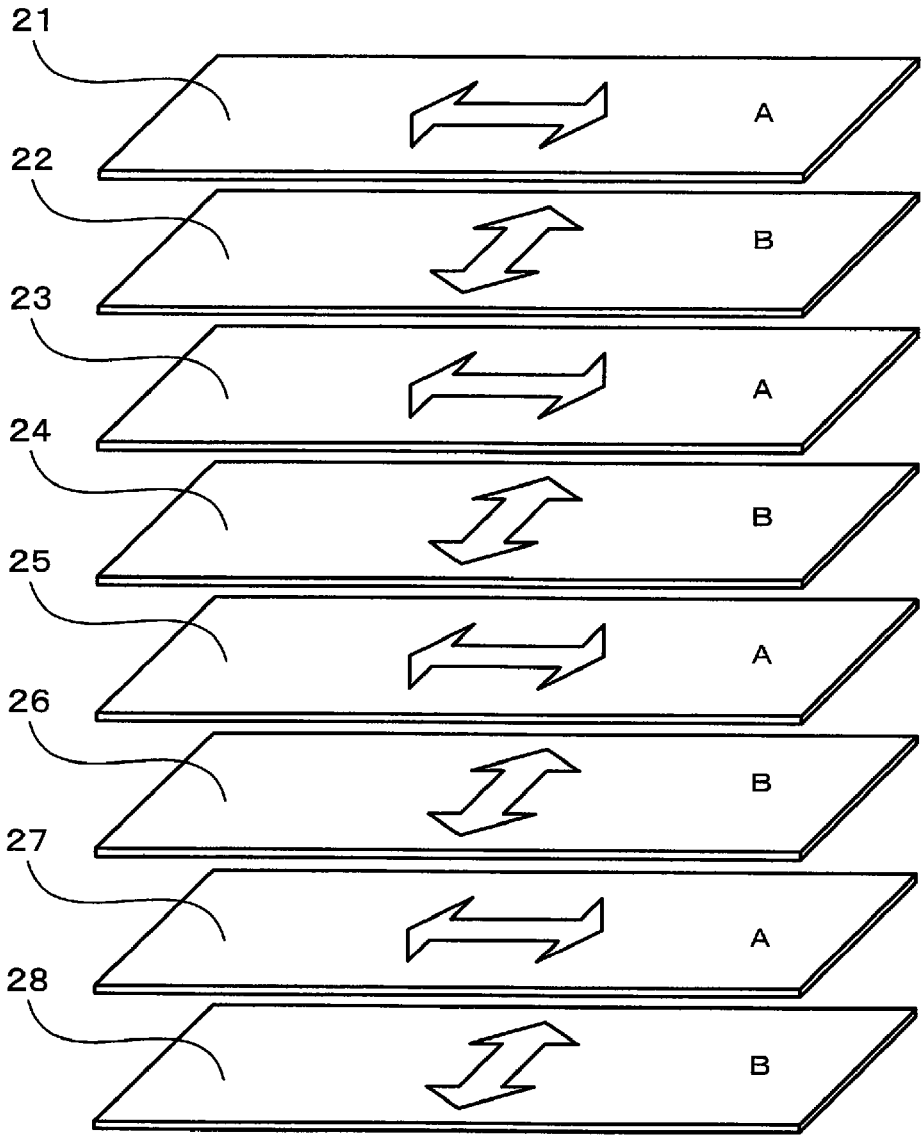
FIG. 5 is an exploded perspective view of a passage unit included in the ink-jet head shown in FIG. 2.

As shown in FIG. 5, in the passage unit 2 which is the layered body of the eight metal plates 21 to 28, the first rolled plate and the second rolled plates are alternately put in layers. The four first rolled plates 21, 23, 25, and 27 have internal stress forcing themselves to bend along their lengthwise direction which is their rolling direction. On the other hand, the four second rolled plates 22, 24, 26, and 28 have internal stress forcing themselves to bend along their widthwise direction which is their rolling direction. Since the eight metal plates 21 to 28 have the same thickness, a total thickness of all the first rolled plates 21, 23, 25, and 27 is the same as a total thickness of all the second rolled plates 22, 24, 26, and 28.

Referring to FIG. 2 again, a plurality of actuators are provided in the actuator unit 3, and the number of the actuators is the same as the number of pressure chambers 42 so that ejection energy can be individually applied to ink contained in the respective pressure chambers 42. The actuator unit 3 is mounted on the upper face of the passage unit 2 so as to close openings of the respective pressure chambers 42. The actuator unit 3 has a layered structure laminated with, from a top, a plurality of individual electrodes 31, a piezoelectric layer 32, a common electrode 34, a piezoelectric layer 33. The plurality of individual electrodes 31 are disposed so as to be opposed to the plurality of pressure chambers 42, respectively. The individual electrodes 31 and the common electrode 34 are made of a metallic material such as an Ag—Pd-based one. The piezoelectric layers 32 and 33 are made of a lead zirconate titanate (PZT)-base ceramic material having ferroelectricity. The piezoelectric layer 32 is sandwiched between the plurality of individual electrodes 31 and the common electrode 34, and the piezoelectric layer 33 is sandwiched between the common electrode 34 and the upper face of the passage unit 2. The piezoelectric layer 33 is fixed to an upper face of the first rolled plate 21.

When a voltage pulse is supplied from a not-shown driver to an individual electrode 31, an electric field is applied to the piezoelectric layer 32 which is an active layer. Thus, due to a transversal piezoelectric effect, the piezoelectric layer 32 becomes ready to contract in a direction perpendicular to the electric field. The piezoelectric layer 33 which is an inactive layer does not deform by itself. As a result, a region of the actuator unit 3 corresponding to each individual electrode 31 presents a unimorph deformation protruding toward a pressure chamber 42. This reduces a volume of the pressure chamber 42 opposed to this individual electrode 31. Consequently, ejection energy is applied to ink contained in the pressure chamber 42, so that an ink droplet is ejected from an ejection port 43 which communicates with the pressure chamber 42.

Figure 6:
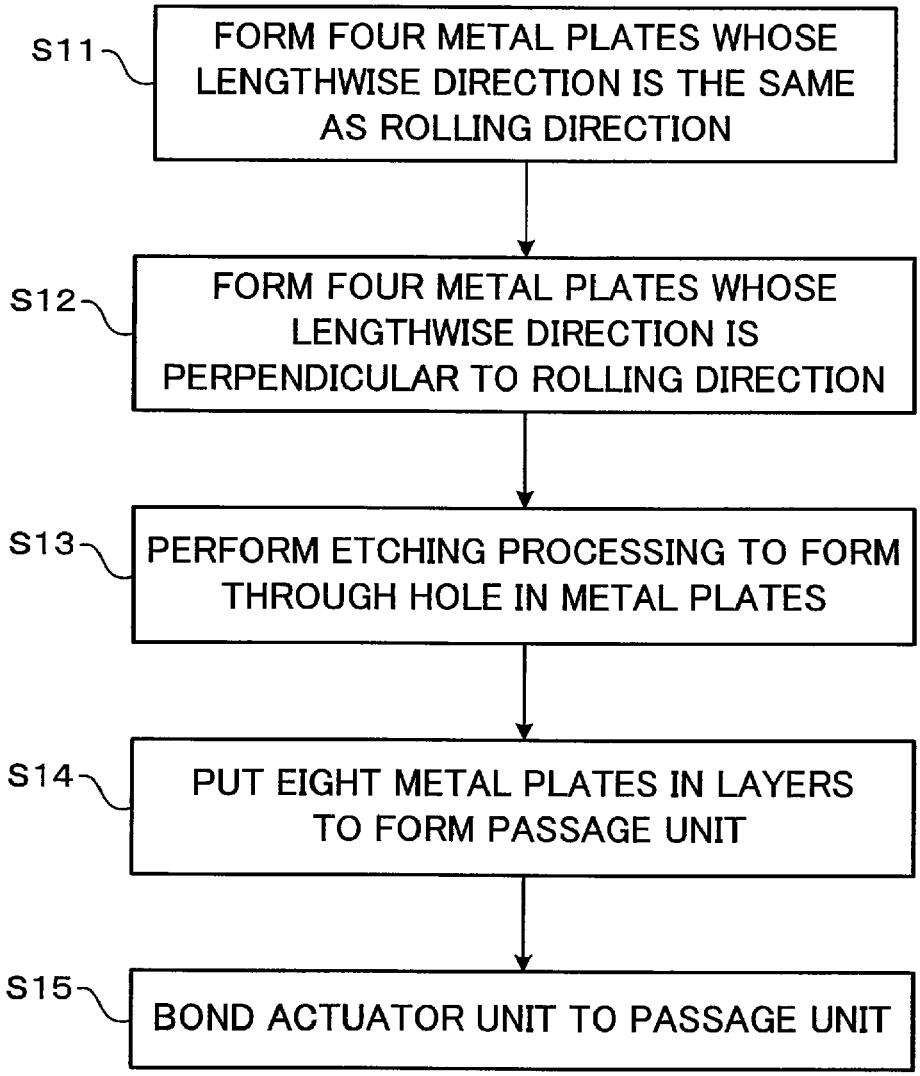
FIG. 6 is a process chart explaining a method of manufacturing the ink-jet head shown in FIG. 1.

A method of manufacturing the ink-jet head 1 will be described further with reference to FIG. 6. First, in S11, a stamping is performed on an unwound portion of the roll of material 50, to form the first rolled plates 21, 23, 25, and 27. At this time, a stamping is performed using a punch so as to make a lengthwise direction of the first rolled plates 21, 23, 25, and 27 identical to the rolling direction of the roll of material 50. In a modification, the first rolled plates 21, 23, 25, and 27 may be formed by a processing method other than the stamping, for example by a laser-beam machining.

Then, in S12, a stamping is performed on an unwound portion of the roll of material 50, to form the second rolled plates 22, 24, 26, and 28. At this time, a stamping is performed using a punch so as to make a lengthwise direction of the second rolled plates 22, 24, 26, and 28 perpendicular to the rolling direction of the roll of material 50.

Then, in S13, an etching processing is performed on the metal plates 21 to 28, to form through holes in the metal plates 21 to 28. The through holes constitute parts of the common ink chamber 41 and the individual ink passages 44. In a modification, it may be possible that through holes are formed in regions of the roll of material 50 which will be the respective metal plates by an etching process and then the metal plates 21 to 28 are formed by a stamping.

Further, in S14, the eight metal plates 21 to 28 are put in layers with a thermosetting adhesive in such a manner that the respective through holes communicate with each other to form the common ink chamber 41 and the individual ink passages 44. At this time, the first rolled plates and the second rolled plates are alternately put in layers as shown in FIG. 5. Then, a heating and pressure application processing is performed to cure the thermosetting adhesive. Thereby, the passage unit is formed. In a modification, it may be possible to bond the eight metal plates 21 to 28 by a metal joining without using an adhesive.

Finally, in S15, the actuator unit 3 is disposed on the upper face of the passage unit 2 with a thermosetting adhesive interposed therebetween. At this time, the pressure chambers 42 and the individual electrodes 31 are opposed to each other. Then, a heating and pressure application processing is performed to cure the thermosetting adhesive. Thereby, the actuator unit 3 is fixed to the upper face of the passage unit 2. Through the above-described steps, manufacturing of the ink-jet head 1 is completed.

Like this, in the passage unit 2, the rolling direction of the four first rolled plates 21, 23, 25, and 27 and the rolling direction of the four second rolled plates 22, 24, 26, and 28 are different from each other. Accordingly, in a layered body of the eight metal plates 21 to 28, the four second rolled plates 22, 24, 26, and 28 restrain the four first rolled plates 21, 23, 25, and 27 from bending along their rolling direction, while the four first rolled plates 21, 23, 25, and 27 restrain the four second rolled plates 22, 24, 26, and 28 from bending along their rolling direction. Therefore, the passage unit 2 does not easily bend, and a dimension accuracy of the ink-jet head 1 is improved. This can reduce an amount of positional shift of the pressure chambers 42 relative to the individual electrodes 31. As a result, ejection energy applied to ink in the pressure chambers 42 is uniformized, and thus ink droplet ejection characteristics are also uniformized. In addition, rigidity of the ink-jet head 1 is improved.

In this embodiment, particularly, the rolling direction of the four first rolled plates 21, 23, 25, and 27 and the rolling direction of the four second rolled plates 22, 24, 26, and 28 are perpendicular to each other. This can efficiently restrain the eight metal plates 21 to 28 from bending along the rolling direction.

Further, over a whole of the passage unit 2, the first rolled plates 21, 23, 25, 27, and the second rolled plates 22, 24, 26, 28, are alternately put in layers. This can more efficiently restrain the eight metal plates 21 to 28 from bending along their rolling direction. Here, in a modification, it may be possible that a region where the first rolled plates 21, 23, 25, 27 and the second rolled plates 22, 24, 26, 28, are alternately put in layers is only a part of the passage unit 2. However, in terms of effectively restraining the passage unit 2 from bending, it is preferable that the region where the plates are alternately put in layers has a thickness equal to or greater than 50 percent of a thickness of the passage unit 2.

In this embodiment, in addition, a total thickness of the four first rolled plates 21, 23, 25, and 27 is the same as a total thickness of the four second rolled plates 22, 24, 26, and 28. Accordingly, there is a small difference between total stress forcing the four first rolled plates 21, 23, 25, and 27 to bend and total stress forcing the four second rolled plates 22, 24, 26, and 28 to bend. Therefore, the passage unit 2 can be restrained from bending very effectively.

Next, a description will be given to an ink-jet head which is a second embodiment of a droplet ejection head according to the present invention. An ink-jet head of this embodiment differs from the ink-jet head 1 of the first embodiment, only in a passage unit. In the following, therefore, only a passage unit will be described, and other members will be denoted by the same reference numerals without specific descriptions thereof.

In this embodiment, a passage unit is a layered body laminated with eight metal plates 121 to 128 made of stainless steel, from the top. The respective metal plates 121 to 128 have substantially the same thickness. The metal plates 121 to 128, which constitute the passage unit, are prepared by forming through holes by etching in metal plates which have been obtained by stamping a roll of material 50 which is an original material made of stainless steel. The roll of material 50 is a long thin plate made of stainless steel being rolled and wound along a rolling direction. Accordingly, a rolling direction of a portion of the roll of material 50 unwound therefrom is the same as a winding direction of the roll of material 50, that is, an extending direction of the unwound portion of the roll of material 50. Therefore, the unwound portion of the roll of material 50 has internal stress forcing the portion to bend along the rolling direction so as to form an inner surface into a concave shape.

Figure 7:
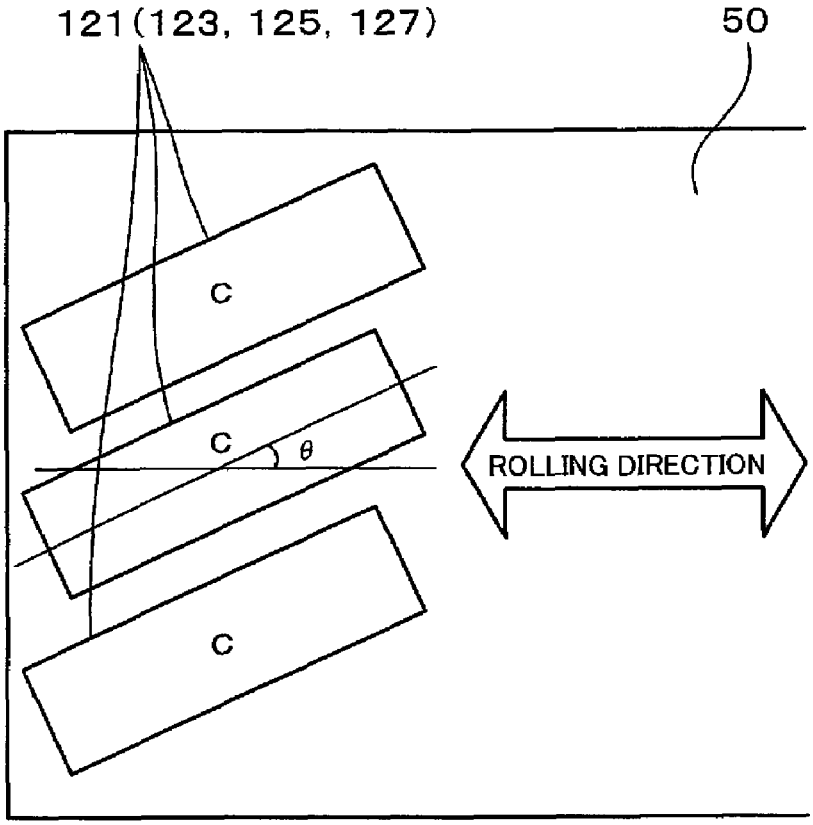
FIG. 7 is an explanatory view showing a relationship between a rolling direction and a lengthwise direction of a part of metal plates included in an ink-jet head according to a second embodiment of the present invention.
Figure 8:
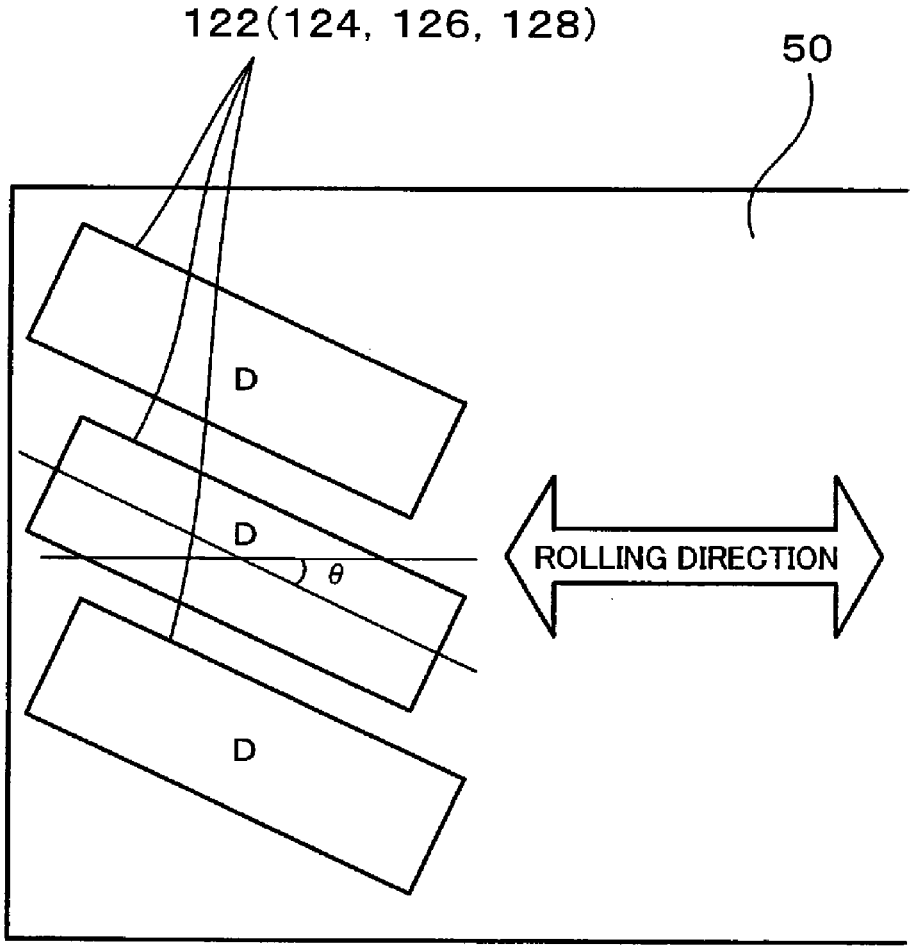
FIG. 8 is an explanatory view showing a relationship between the rolling direction and a lengthwise direction of a rest of the metal plates included in the ink-jet head according to the second embodiment of the present invention.

In this embodiment, as shown in FIG. 7, the metal plates 121, 123, 125, and 127 are stamped out of the roll of material 50 in such a manner that a lengthwise direction of the metal plates 121, 123, 125, and 127 is inclined at an angle θ with respect to the rolling direction of the roll of material 50. On the other hand, as shown in FIG. 8, the metal plates 122, 124, 126, and 128 are stamped out of the roll of material 50 in such a manner that a lengthwise direction of the metal plates 122, 124, 126, and 128 is inclined in a direction opposite to an inclination of the lengthwise direction of the metal plates 121, 123, 125, and 127, at an angle θ with respect to the rolling direction of the roll of material 50, that is, in such a manner that a lengthwise direction of the metal plates 122, 124, 126, and 128 is inclined at an angle −θ with respect to the rolling direction of the roll of material 50. In a following description, the metal plates 121, 123, 125, and 127 will sometimes be referred to as "third rolled plates" (which are denoted by reference character C in FIGS. 7 and 9), and the metal plates 122, 124, 126, and 128 will sometimes be referred to as "fourth rolled plates" (which are denoted by reference character D in FIGS. 8 and 9).

Figure 9:
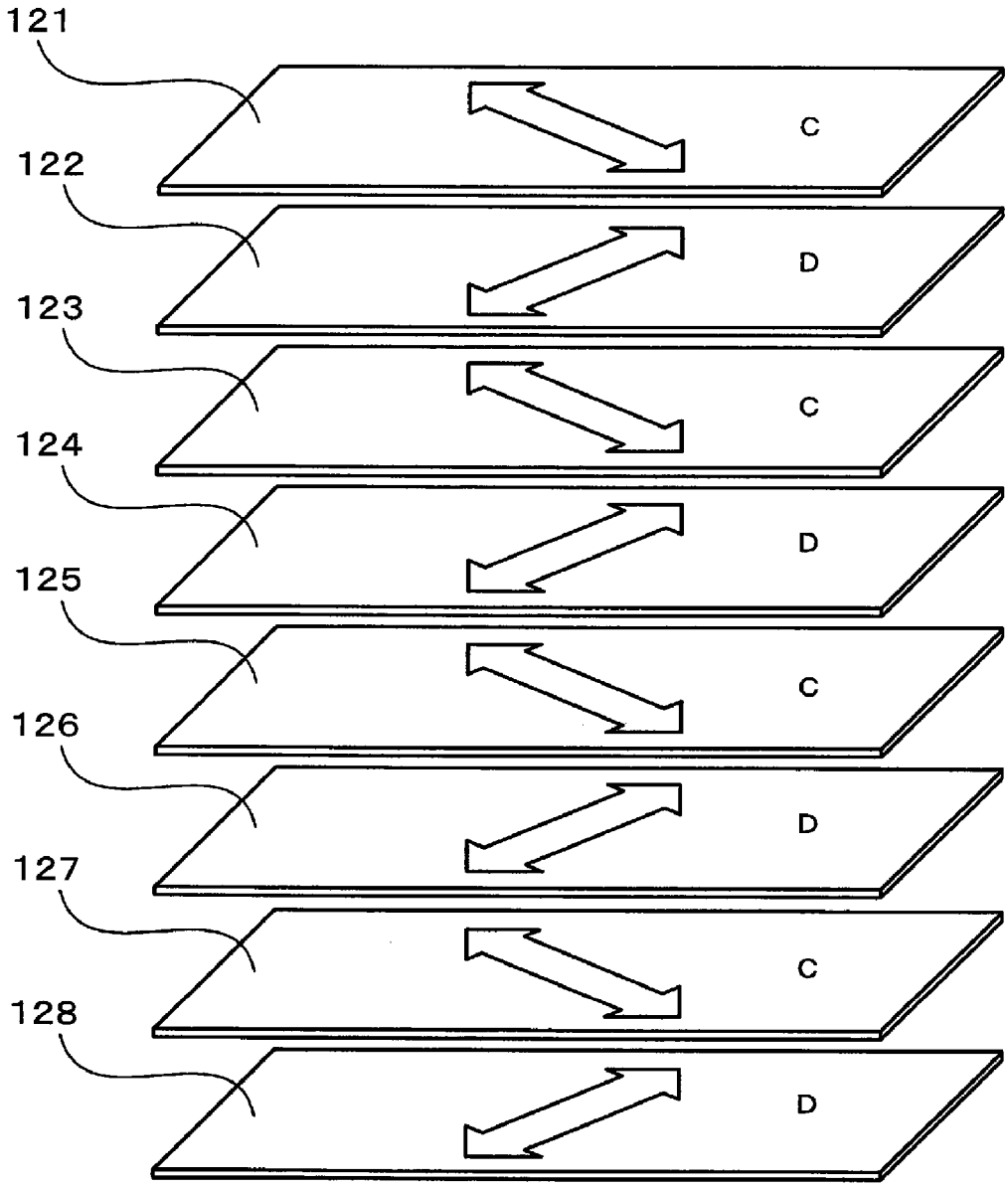
FIG. 9 is an exploded perspective view of a passage unit included in the ink-jet head according to the second embodiment of the present invention.

As shown in FIG. 9, in the passage unit which is the layered body of the eight metal plates 121 to 128, the third rolled plate and the fourth rolled plates are alternately put in layers. The four third rolled plates 121, 123, 125, and 127 have internal stress forcing themselves to bend along the rolling direction which is inclined at the angle θ clockwise with respect to their lengthwise direction. On the other hand, the four fourth rolled plates 122, 124, 126, and 128 have internal stress forcing themselves to bend along the rolling direction which is inclined at the angle θ counterclockwise with respect to their lengthwise direction. Since the eight metal plates 121 to 128 have the same thickness, a total thickness of all the third rolled plates 121, 123, 125, and 127 is the same as a total thickness of all the fourth rolled plates 122, 124, 126, and 128.

Figure 10:
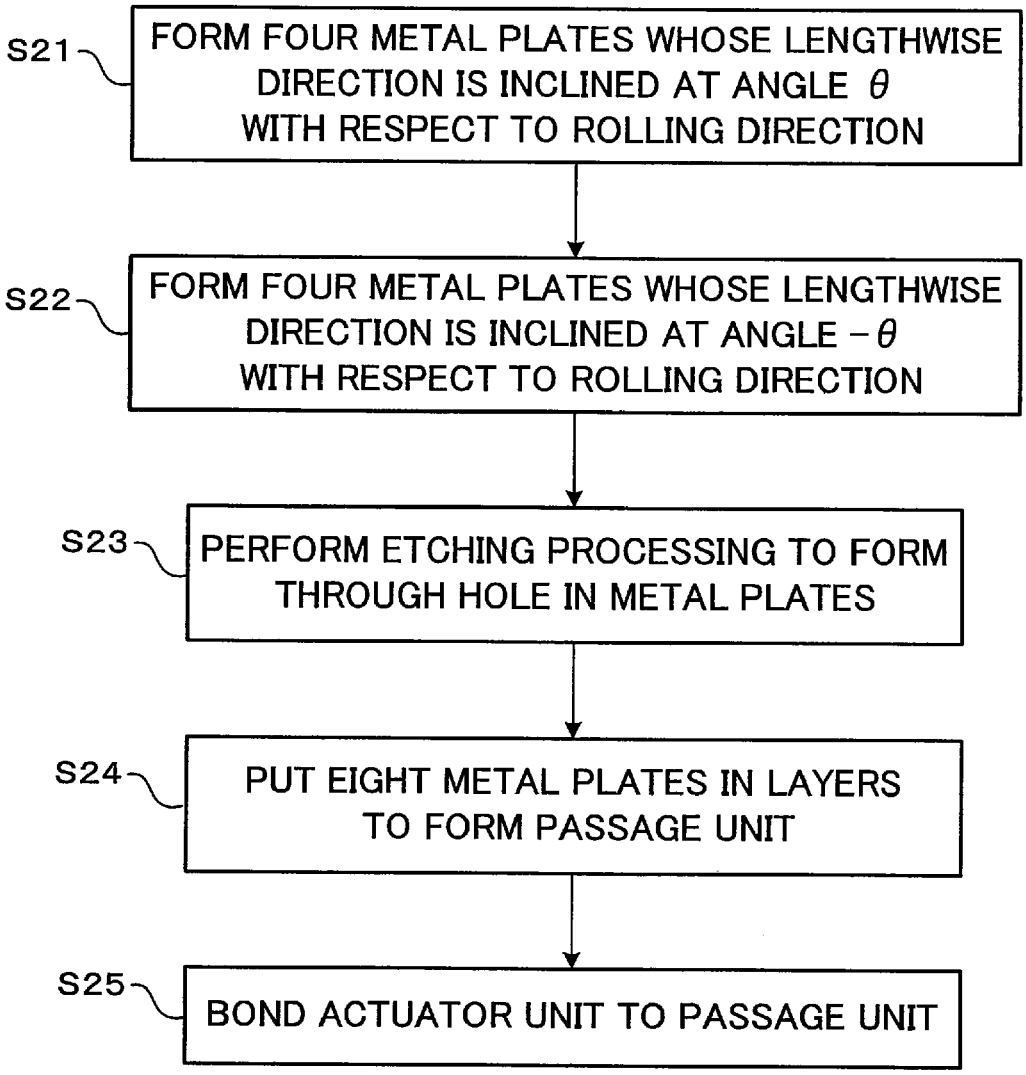
FIG. 10 is a process chart explaining a method of manufacturing the ink-jet head according to the second embodiment of the present invention.

A method of manufacturing the ink-jet head of this embodiment will be described further with reference to FIG. 10. First, in S21, a stamping is performed on an unwound portion of the roll of material 50, to form the third rolled plates 121, 123, 125, and 127. At this time, a stamping is performed using a punch so as to make a lengthwise direction of the third rolled plates 121, 123, 125, and 127 inclined at the angle θ with respect to the rolling direction of the roll of material 50. In a modification, the third rolled plates 121, 123, 125, and 127 may be formed by a processing method other than the stamping, for example by a laser-beam machining.

Then, in S22, a stamping is performed on an unwound portion of the roll of material 50, to form the fourth rolled plates 122, 124, 126, and 128. At this time, a stamping is performed using a punch so as to make a lengthwise direction of the fourth rolled plates 122, 124, 126, and 128 inclined at the angle −θ with respect to the rolling direction of the roll of material 50.

Then, in S23, an etching processing is performed on the metal plates 121 to 128, to form through holes in the metal plates 121 to 128. The through holes constitute parts of the common ink chamber 41 and the individual ink passages 44.

Further, in S24, the eight metal plates 121 to 128 are put in layers with a thermosetting adhesive in such a manner that the respective through holes communicate with each other to form the common ink chamber 41 and the individual ink passages 44. At this time, the third rolled plates and the fourth rolled plates are alternately put in layers as shown in FIG. 9. Then, a heating and pressure application processing is performed to cure the thermosetting adhesive. Thereby, the passage unit is formed.

Finally, in S25, the actuator unit 3 is disposed on the upper face of the passage unit with a thermosetting adhesive interposed therebetween. At this time, the pressure chambers 42 and the individual electrodes 31 are opposed to each other. Then, a heating and pressure application processing is performed to cure the thermosetting adhesive. Thereby, the actuator unit 3 is fixed to the upper face of the passage unit. Through the above-described steps, manufacturing of the ink-jet head is completed.

Like this, in the passage unit, the rolling direction of the four third rolled plates 121, 123, 125, and 127 and the rolling direction of the four fourth rolled plates 122, 124, 126, and 128 are different from each other. Accordingly, in a layered body of the eight metal plates 121 to 128, the four fourth rolled plates 122, 124, 126, and 128 restrain the four third rolled plates 121, 123, 125, and 127 from bending along their rolling direction, while the four third rolled plates 121, 123, 125, and 127 restrain the four fourth rolled plates 122, 124, 126, and 128 from bending along their rolling direction. Therefore, the passage unit does not easily bend, and a dimension accuracy of the ink-jet head is improved. This can reduce an amount of positional shift of the pressure chambers 42 relative to the individual electrodes 31. As a result, ejection energy applied to ink in the pressure chambers 42 is uniformized, and thus ink droplet ejection characteristics are also uniformized. In addition, rigidity of the ink-jet head is improved.

In this embodiment, unlike in the first embodiment, it is not necessary that the rolling directions of the two kinds of rolled plates are perpendicular to each other. Therefore, when either of the third rolled plates 121, 123, 125, 127 and the fourth rolled plates 122, 124, 126, 128 is obtained from the roll of material 50, a relatively large number of plates can be obtained per unit area of the roll of material 50. Consequently, an amount of the roll of material 50 wastefully discarded can be reduced as much as possible. Therefore, costs for the ink-jet head can be reduced.

Further, over a whole of the passage unit, the third rolled plates 121, 123, 125, 127, and the fourth rolled plates 122, 124, 126, 128, are alternately put in layers. This can more efficiently restrain the eight metal plates 121 to 128 from bending along their rolling direction. In this embodiment as well, it is preferable that a region where the third plates and the fourth plates are alternately put in layers has a thickness equal to or greater than 50 percent of a thickness of the passage unit.

In this embodiment, in addition, a total thickness of the four third rolled plates 121, 123, 125, and 127 is the same as a total thickness of the four fourth rolled plates 122, 124, 126, and 128. Therefore, the passage unit can be restrained from bending very effectively.

Other modifications of the above-described embodiments will be described. The present invention is not limited to that there is a special angle relationship between the first rolled plate and the second rolled plate, or between the third rolled plate and the fourth rolled plate as in the first and second embodiments described above. That is, in a case where a layered body of a plurality of metal plates includes m metal plates (m represents an arbitrary natural number equal to or greater than 1) whose lengthwise directions form the same angle with respect to the rolling direction and n metal plates (n represents an arbitrary natural number equal to or greater than 1) whose lengthwise directions form the same angle with respect to the rolling direction, it suffices that the angle formed between the lengthwise direction of the m metal plates and the rolling direction is different from the angle formed between the lengthwise direction of the n metal plates and the rolling direction.

In the above-described first and second embodiments, the number of each of the first to fourth rolled plates is four. However, the number of each of the first to fourth rolled plates may be any number as long as it is equal to or greater than 1. In addition, it may not always necessary that the first rolled plates and the second rolled plates, or the third rolled plates and the fourth rolled plates, are alternately put in layers. The effect that the passage unit is restrained from bending can be obtained even though one or a plurality of first rolled plates (third rolled plates) and one or a plurality of second rolled plates (fourth rolled plates) are arranged in any order.

Moreover, although in the above-described embodiment all the metal plates 21 to 28 in the passage unit 2 have substantially the same thickness, these metal plates may have different thicknesses.

Further, a total thickness of one or a plurality of first rolled plates (third rolled plate) and a total thickness of one or a plurality of second rolled plates (fourth rolled plate) are different from each other. However, in terms of effectively restraining the passage unit 2 from bending, it is preferable that a total thickness of the one is equal to or smaller than twice a total thickness of the other.

In the above-described first embodiment, the eight metal plates 21 to 28 which constitute the passage unit 2 are made up of only the four first rolled plates 21, 23, 25, 27 and the four second rolled plates 22, 24, 26, 28. In this embodiment, however, a plurality of metal plates which constitute a layered body may include a metal plate other than the first and second rolled plates, that is, such a metal plate that an angle formed between its lengthwise direction and the rolling direction is different from the angles formed between the lengthwise directions of the first and second rolled plates and the rolling direction. In this case, the effect that the passage unit is restrained from bending can be obtained even though the first rolled plates, the second rolled plates, and other metal plates are arranged in any order. The same applies to the second embodiment.

In the above-described embodiment, the present invention is applied to an ink-jet head which ejects ink droplets as an example. However, the present invention is applicable to all droplet ejection heads which eject droplets of anything other than ink, such as a metal paste. It may also be possible to apply the present invention to a part of the ink-jet head other than the passage unit.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A droplet ejection head comprising a layered body made up of a plurality of metal plates in which at least a part of a liquid passage is formed, and an ejection face in which an ejection port provided at one end of the liquid passage and ejecting an ink droplet is formed, wherein the plurality of metal plates in the layered body include m metal plates (m represents an arbitrary natural number equal to or greater than 1) whose lengthwise directions form the same angle with a rolling direction thereof, and n metal plates (n represents an arbitrary natural number equal to or greater than 1) whose lengthwise directions form the same angle with the rolling direction, and the angle formed between the lengthwise direction of the m metal plates and the rolling direction is different from the angle formed between the lengthwise direction of the n metal plates and the rolling direction.

2. The droplet ejection head according to claim 1, wherein the lengthwise direction of the m metal plates is the same as the rolling direction, and the lengthwise direction of the n metal plates is perpendicular to the rolling direction.

3. The droplet ejection head according to claim 1, wherein the angle formed between the lengthwise direction of the m metal plates and the rolling direction is the same in size as but opposite in sign to the angle formed between the lengthwise direction of the n metal plates and the rolling direction.

4. The droplet ejection head according to claim 1, wherein the layered body has a region in which any of the m metal plates and any of the n metal plates are alternately put in layers.

5. The droplet ejection head according to claim 4, wherein the region has a thickness equal to or greater than 50 percent of a thickness of the layered body.

6. The droplet ejection head according to claim 1, wherein, in the layered body, a total thickness of the m metal plates is the same as a total thickness of the n metal plates.

7. A method of manufacturing a droplet ejection head comprising a layered body made up of a plurality of metal plates in which at least a part of a liquid passage is formed, and an ejection face in which an ejection port provided at one end of the liquid passage and ejecting an ink droplet is formed, the method comprising:

a first metal plate forming step in which m metal plates (m represents an arbitrary natural number equal to or greater than 1) whose lengthwise directions form the same angle with a rolling direction thereof are formed from an unwound portion of a roll of long material which is wound along the rolling direction;

a second metal plate forming step in which n metal plates (n represents an arbitrary natural number equal to or greater than 1) whose lengthwise directions form the same angle with a rolling direction thereof are formed from an unwound portion of a roll of long material which is wound along the rolling direction, the angle formed between the lengthwise direction of the m metal plates and the rolling direction being different from the angle formed between the lengthwise direction of the n metal plates and the rolling direction;

a through hole forming step in which a through hole which constitutes a part of the liquid passage is formed in each of the plurality of metal plates including the m metal plates and the n metal plates; and a layered body forming step in which the layered body made up of the plurality of metal plates are formed in such a manner that a plurality of through holes communicate with each other.

8. The method according to claim 7, wherein, in the first metal plate forming step, the lengthwise direction of the m metal plates is made the same as the rolling direction, and, in the second metal plate forming step, the lengthwise direction of the n metal plates is made perpendicular to the rolling direction.

9. The method according to claim 7, wherein:

in the first metal plate forming step, the m metal plates are formed in such a manner that the lengthwise direction of the metal plates is inclined with respect to the rolling direction; and in the second metal plate forming step, an angle formed between the lengthwise direction of the n metal plates and the rolling direction is made the same in size as but opposite in sign to an angle formed between the lengthwise direction of the m metal plates and the rolling direction.

10. The method according to claim 9, wherein the region has a thickness equal to or greater than 50 percent of a thickness of the layered body.

11. The method according to claim 7, wherein, in the layered body forming step, the layered body made up of the plurality of metal plates is formed in such a manner that the layered body has a region in which any of the m metal plates and any of the n metal plates are alternately put in layers.

12. The method according to claim 7, wherein, in the layered body forming step, the layered body made up of the plurality of metal plates is formed in such a manner that, in the layered body, a total thickness of the m metal plates is the same as a total thickness of the n metal plates.

* * * * *